US011699426B1

(12) United States Patent
Ryan

(10) Patent No.: US 11,699,426 B1
(45) Date of Patent: Jul. 11, 2023

(54) DIRECTION-DEPENDENT SINGLE-SOURCE FORWARD CANCELLATION

(71) Applicant: SEMICONDUCTOR COMPONENTS INDUSTRIES, LLC, Phoenix, AZ (US)

(72) Inventor: James Gregory Ryan, Ottawa (CA)

(73) Assignee: SEMICONDUCTOR COMPONENTS INDUSTRIES, LLC, Scottsdale, AZ (US)

( * ) Notice: Subject to any disclaimer, the term of this patent is extended or adjusted under 35 U.S.C. 154(b) by 0 days.

(21) Appl. No.: 17/670,258

(22) Filed: Feb. 11, 2022

(51) Int. Cl.
*G10K 11/178* (2006.01)
*H04R 1/40* (2006.01)
*H04R 3/00* (2006.01)

(52) U.S. Cl.
CPC .. *G10K 11/17854* (2018.01); *G10K 11/17823* (2018.01); *G10K 11/17825* (2018.01); *G10K 11/17881* (2018.01); *H04R 1/406* (2013.01); *H04R 3/005* (2013.01); *G10K 2210/3026* (2013.01); *G10K 2210/3027* (2013.01); *G10K 2210/3028* (2013.01)

(58) Field of Classification Search
None
See application file for complete search history.

(56) References Cited

U.S. PATENT DOCUMENTS

| | | | |
|---|---|---|---|
| 5,473,701 | A | 12/1995 | Cezanne et al. |
| 10,424,287 | B2 | 9/2019 | Guiu et al. |
| 10,497,357 | B2 | 12/2019 | Christoph |
| 10,755,690 | B2 | 8/2020 | Mohammad et al. |
| 11,056,095 | B2 | 7/2021 | Christoph |
| 2011/0158419 | A1* | 6/2011 | Theverapperuma ..... H04R 1/1083 381/71.1 |

FOREIGN PATENT DOCUMENTS

WO WO-2010124176 A1 * 10/2010 ..... G10K 11/178

* cited by examiner

*Primary Examiner* — Kenny H Truong
(74) *Attorney, Agent, or Firm* — Ramey LLP

(57) ABSTRACT

Active noise cancellation systems, components, and methods are provided with single-source forward cancellation using a direction-dependent filter response. One illustrative active sound cancelling device includes: a primary external microphone that produces a primary receive signal; a secondary external microphone that produces a secondary receive signal, the primary and secondary receive signals representing ambient audio that potentially includes sound having a predominate direction of arrival; a speaker that converts an output signal into internal audio to at least partly cancel said sound, the output signal including a forward cancellation signal; a forward filter that operates solely on the primary receive signal to produce the forward cancellation signal; and a direction finder that operates on the primary and secondary receive signals to derive an estimate of said predominate direction of arrival, the direction finder adjusting the forward filter to implement a filter response corresponding to said estimate.

20 Claims, 3 Drawing Sheets

Fig. 1
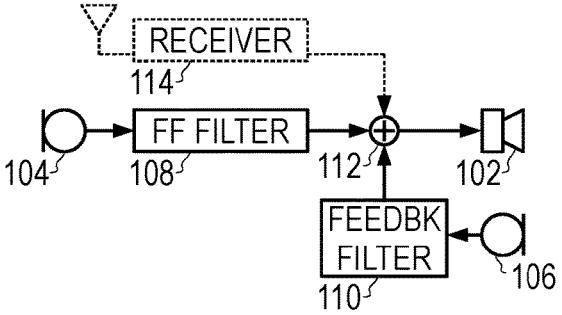
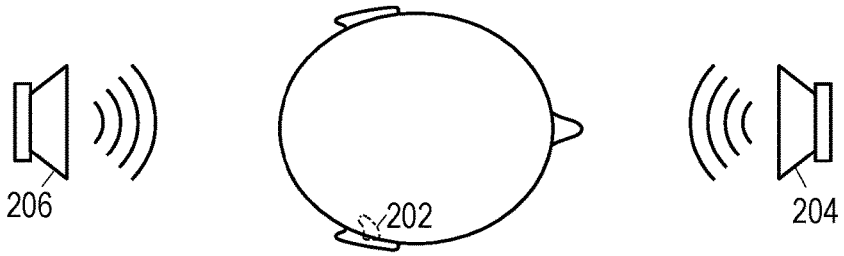
Fig. 2
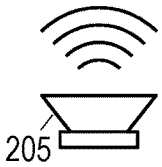
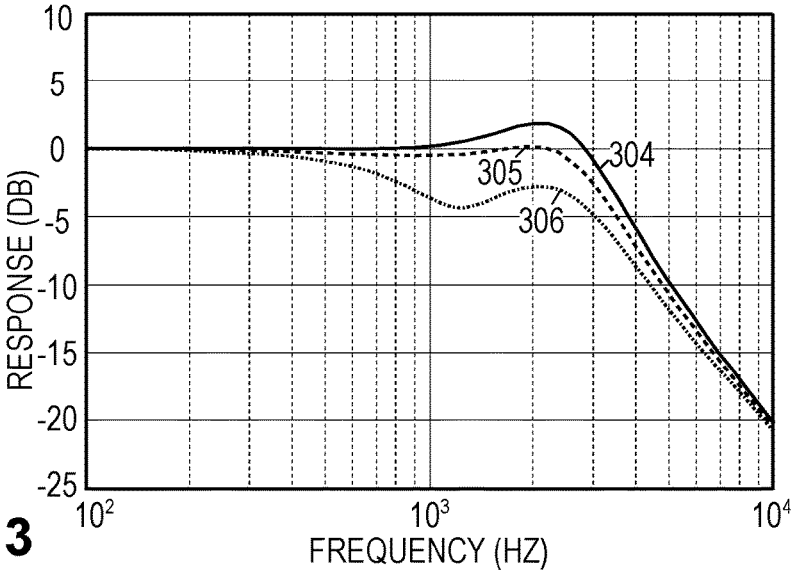
Fig. 3

Fig. 4
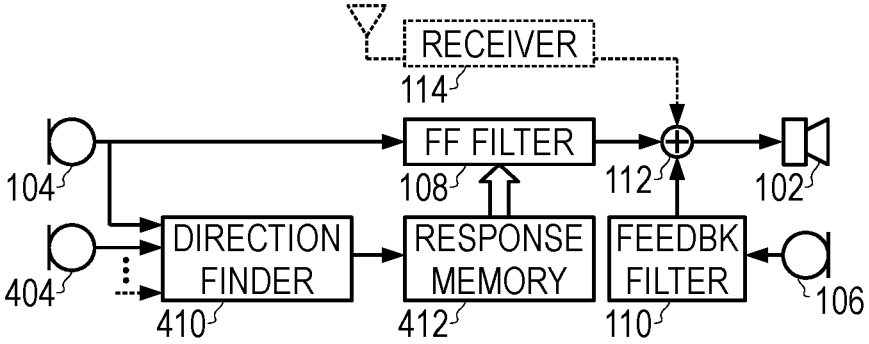
Fig. 5
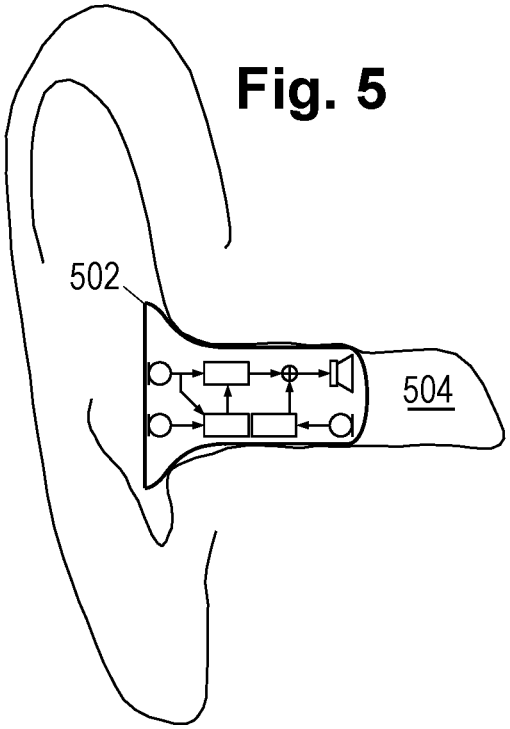
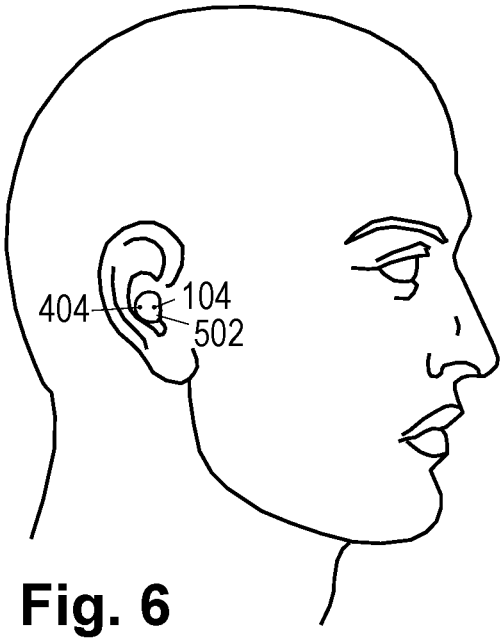
Fig. 6

DIRECTION-DEPENDENT SINGLE-SOURCE FORWARD CANCELLATION

BACKGROUND

Active noise cancellation systems have been developed for use in many situations where passive noise control systems are impractical or insufficient. Such systems reduce unwanted noise by generating acoustic waves designed to cancel that sound ("anti-noise"). Often, such systems position a speaker to generate the anti-noise in or near each ear of the user. For example, the speaker can be mounted in a headphone cup, earphone pad, or an earbud. Microphones can be positioned upstream (further from the eardrum) or downstream (closer to the eardrum) than the speaker. Upstream microphones are also known as external microphones because they measure sound external to the protected space over or in the ear. Relatedly, downstream microphones are known as internal microphones because they measure sound within the protected space.

Internal microphones enable feedback control, so active noise cancellation systems using internal microphones are said to provide "feedback cancellation". By way of contrast, active noise cancellation systems using external microphones are said to provide "feed-forward cancellation" or simply "forward cancellation". Systems using both internal and external microphones are referred to herein as hybrid cancellation systems.

Forward cancellation systems tend to be the simplest, and thus most energy efficient. However, their performance is heavily dependent on how well the internal filter response matches the transfer function of the noise propagation path. Feedback cancellation systems can provide exceptional performance, but generally rely on complex filter adaptation strategies to do so. Hybrid cancellation systems can trade off these benefits and costs to provide superior performance with good energy efficiency, potentially enabling the development of battery-powered active earplugs as well as more efficient wireless earbuds and headphones.

As with forward cancellation systems, however, such hybrid cancellation systems would benefit from better matching of the internal filter response to the transfer function of the noise propagation path, so long as the matching can be performed in an energy-efficient manner.

SUMMARY

Accordingly, there are disclosed herein active noise cancellation systems, components, and methods, that provide single-source forward cancellation using a direction-dependent filter response. One illustrative active sound cancelling device includes: a primary external microphone that produces a primary receive signal; a secondary external microphone that produces a secondary receive signal, the primary and secondary receive signals representing ambient audio that potentially includes sound having a predominate direction of arrival; a speaker that converts an output signal into internal audio to at least partly cancel said sound, the output signal including a forward cancellation signal; a forward filter that operates solely on the primary receive signal to produce the forward cancellation signal; and a direction finder that operates on the primary and secondary receive signals to derive an estimate of said predominate direction of arrival, the direction finder adjusting the forward filter to implement a filter response corresponding to said estimate.

An illustrative electronic component includes integrated circuitry for: a forward filter configured to operate solely on a primary receive signal from a primary external microphone to produce a forward cancellation signal that forms, or is an additive component of, an output signal for a speaker; and a direction finder configured to combine the primary receive signal with a secondary receive signal from a secondary external microphone to derive an estimate of a predominate direction of arrival of sound represented by the primary and secondary receive signals, the direction finder further configured to adjust the forward filter to implement a filter response corresponding to said estimate.

An illustrative sound cancelling method for use in a hearing protection device includes: operating on primary and secondary receive signals from primary and secondary external microphones, respectively, to derive an estimate of a predominate direction of arrival of sound represented by the primary and secondary receive signals; selecting a forward filter response corresponding to said estimate; applying the forward filter response exclusively to the primary receive signal to produce a forward cancellation signal, the forward cancellation signal forming, or being an additive component of, an output signal; and supplying the output signal to a speaker to at least partly cancel said sound.

Each of the foregoing embodiments may be employed separately or conjointly, and may optionally include one or more of the following features in any combination: 1. a memory that stores filter response parameters for each of multiple directions of arrival, wherein the direction finder accesses the stored filter response parameters corresponding to said estimate. 2. the forward filter is a finite impulse response filter, and the filter response parameters are filter coefficients. 3. the forward filter is an analog filter, and the filter response parameters are gain or impedance values for adjustable components of the analog filter. 4. an internal microphone that produces an internal receive signal, and a feedback filter that operates on the internal receive signal to produce an internal cancellation signal, the output signal being a sum of the forward cancellation signal and the internal cancellation signal. 5. a wireless receiver that produces an audio content signal, the audio content signal being an additive component of the output signal. 6. the secondary external microphone is one of multiple secondary microphones producing multiple secondary receive signals, the multiple secondary receive signals solely being used to derive said estimate.

BRIEF DESCRIPTION OF THE DRAWINGS

FIG. 1 is a signal flow diagram of an illustrative hybrid active noise cancellation device.

FIG. 2 is an environmental view showing differently positioned noise sources.

FIG. 3 is a graph of illustrative transfer functions for different arrival directions.

FIG. 4 is a signal flow diagram of an illustrative active noise cancellation device with direction-dependent single-source forward cancellation.

FIG. 5 is a schematic view of an illustrative earplug with direction-dependent single-source forward cancellation.

FIG. 6 is a side view of an illustrative earplug with direction-dependent single-source forward cancellation.

DETAILED DESCRIPTION

Figure 7:
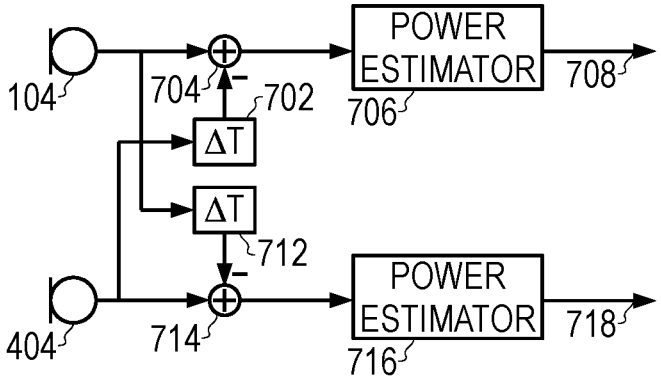
FIG. 7 is a flow diagram of a first illustrative direction finder.

The attached drawings and following description set out particular embodiments and details for explanatory purposes, but the drawings and corresponding detailed description do not limit the disclosure. On the contrary, they provide a foundation that, together with the understanding of one of ordinary skill in the art, discloses and enables all modifications, equivalents, and alternatives falling within the scope of the appended claims.

FIG. 1 shows an illustrative active noise cancellation device having hybrid cancellation. An in-ear or near-ear speaker 102 generates anti-noise sound based at least in part on an audio signals detected by external microphone 104 and internal microphone 106. Feed-forward filter 108 operates on the external audio signal to provide a forward cancellation signal, while feedback filter 110 operates on the internal audio signal to produce a feedback cancellation signal. A combiner 112, shown here as a summation node, sums the forward cancellation signal with the feedback cancellation signal and an optional audio content signal from optional wireless receiver 114 to produce an output signal for speaker 102.

Experience reveals that at least some external noise always propagates past any earplug, ear pod, earphone pad, or headphone cup (collectively referred to herein as "hearing protector") to reach the eardrum. Much of the noise propagates through the structure of the hearing protector itself (especially through any vents or gaps), but a non-negligible fraction also propagates through the bone and tissues of the user's skull. The forward filter 108 is intended to replicate the transfer function of noise propagating through the hearing protector structure, to produce a forward cancellation signal that, when converted into a sound waveform, destructively interferes with that noise. The internal microphone 106 detects the residual noise from other propagation paths and incomplete forward cancellation. The feedback filter 110 compensates for the mechanical characteristics of microphone 106 and speaker 102, as well as the propagation delay of the feedback loop itself, to turn this residual noise measurement into a feedback cancellation signal. This arrangement is expected to provide good, energy-efficient noise cancellation so long as good transfer function matching is achieved.

FIG. 2 is an overhead view of a user's head with an inserted hearing protector 202. Noise propagating from a front noise source 204, a side noise source 205, and a rear noise source 206, encounter the structure of hearing protector 202 from different directions. FIG. 3 shows examples of three different transfer functions in the frequency domain. Curve 304 shows a stronger mid-frequency response that could be observed for noise propagating from front source 204. Curve 305 shows a flatter response curve that might be observed for noise propagating from side source 205. Curve 306 shows an attenuated mid-frequency response that might be observed for noise propagating from rear source 206. These responses are different enough that it is desirable for forward filter 108 to have a selectable response that depends on the noise's direction of arrival.

It is noted here that at least one prior art reference teaches the use of a sophisticated spatial partitioning module having multiple forward filters coupled to an array of external microphones to provide directional sensitivity. See U.S. Pat. No. 10,424,287 ("Guiu"), titled "Active Noise-Control Device", which is hereby incorporated herein by reference. Given the complex frequency dependence of such spatial partitioning and the impact it has on frequency responses of the filters, it is far from clear that such a design can be implemented successfully. Moreover, the associated hardware complexity is undesirable for achieving the desired energy-efficiency and battery longevity.

FIG. 4 shows an alternative active noise cancellation device with a single forward filter 108 that, as in FIG. 1, operates solely on a single signal from a single primary external microphone 104 to derive the forward cancellation signal. The device of FIG. 4 does include one or more secondary external microphones 404 that, together with primary external microphone 104, are coupled to a direction finder circuit 410. Direction finder 410 operates on the microphone signals to determine a predominate direction of arrival for the noise or other ambient audio reaching the microphones. Based on the identified direction, the direction finder 410 accesses a nonvolatile memory 412 to determine parameters of the corresponding filter response.

Thus, with reference to FIG. 3, the direction finder determines whether the direction of arrival is from a front source, side source, or rear source, and uses the associated parameter settings from memory 412 to configure filter 108 for the matching response. Though only three responses are shown in FIG. 3, it is expected that the direction finder will be able to detect at least five different directions and select respective filter parameters for each. Some contemplated implementations may further provide for interpolation between the parameters for the closest corresponding directions. At least some implementations further provide an averaged response or default selection of the side direction for situations where no predominate direction of arrival is detected.

In at least some implementations, filter 108 is a finite impulse response (FIR) or infinite impulse response (IIR) filter implemented with a tapped delay line or digital delay chain, and the stored parameters are tap coefficients for the weighted sum representing the desired filter output. In other implementations, the filter is an analog filter implemented using adjustable components, and the stored parameters are gain or impedance values for those components. The coefficient or component values can be pre-programmed to provide the desired frequency responses.

FIG. 5 shows an illustrative earplug 502 embodying the active noise cancellation device of FIG. 4. The circuitry is preferably embodied in compliant foam to provide passive attenuation, with small external and internal apertures for the microphones and speaker that provide active cancellation in the ear canal 504. FIG. 6 shows a side view of the earplug 502 with the primary microphone 104 horizontally separated from the secondary microphone to enable azimuthal direction detection in the horizontal place. An additional secondary microphone vertically spaced from one of the first two microphones would further enable elevation direction detection in a vertical plane.

It is noted that the filters 108, 110 are preferably implemented to provide highly responsive signal flows from microphones to speaker with a minimal latency (on the order of 50 microseconds or less) to enable superior noise cancellation performance. A much higher latency (approximately 10 to 100 milliseconds) would be acceptable in the direction finder 410, memory 412, and filter adjustment processing path, enabling the use of batch processing and/or a lower clock frequency for increased energy efficiency.

FIG. 7 is a flow diagram of a first illustrative direction finder implementation. A delay element 702 derives a delayed secondary receive signal to be combined with the primary receive signal by combiner 704, which is shown here as a summer that determines the signal difference. A power estimator 706 integrates the combined signal (perhaps using a moving-average filter) to obtain a frontward power estimate signal 708 that is larger when sound is propagating from a forward source and smaller when sound is propagating from a rearward source. Similarly, a delay element 712 derives a delayed primary receive signal to be combined with the secondary receive signal by combiner 714. A power estimator 716 integrates the combined signal to obtain a rearward power estimate signal 718 that is larger when sound is propagating from a rearward source and smaller when sound is propagating from a frontward source. Some variations may use bandpass filtering of the microphone signals to make the direction finder operate in those frequency ranges where the transfer function is most affected by the direction of arrival.

Figure 8:
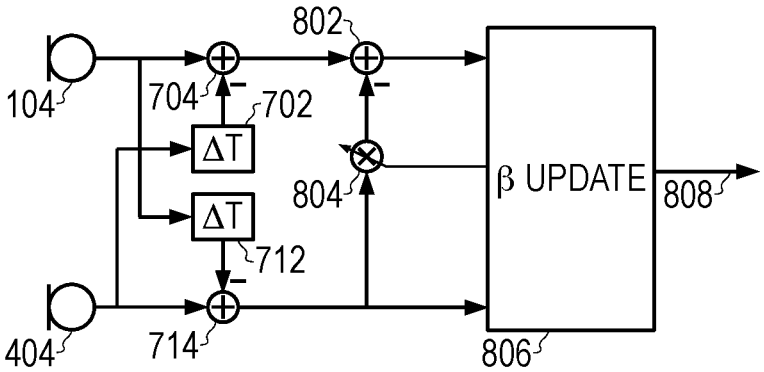
FIG. 8 is a flow diagram of a second illustrative direction finder.

FIG. 8 is a flow diagram of a second illustrative direction finder implementation. In this implementation, combiner 704 subtracts the delayed secondary receive signal from the primary receive signal, thereby synthesizing a combined signal equivalent to the receive signal of a microphone having a frontward-oriented cardioid response. Similarly, combiner 714 subtracts the delayed primary receive signal from the secondary receive signal, thereby achieving a rearward oriented cardioid response. With additional secondary microphones, more complex beamforming can be achieved, though it is preferred to minimize the associated hardware complexity. The use of transducers having mechanically configured directional responses is contemplated.

An adder 802 calculates a weighted difference of the two directional responses, relying on an adjustable gain amplifier 804. An update module 806 systematically or iteratively identifies the gain β that minimizes the weighted difference, which corresponds to the predominate direction of arrival 808. As with the previous example, normalization and bandpass filtering can be employed. More details and variations on this direction finder strategy can be found in U.S. Pat. No. 5,473,701 "Adaptive Microphone Array" by inventors Juergen Cezanne and Gary Elko.

The described direction finders are just two examples. Other suitable direction finders are available in the literature.

Any of the controllers described herein, or portions thereof, may be formed as a semiconductor device using one or more semiconductor dice. Though certain operations may have been described as sequential for explanatory purposes, in practice they may be carried out by multiple integrated circuit components operating concurrently. The sequential discussion is not meant to be limiting. These and numerous other modifications, equivalents, and alternatives, will become apparent to those skilled in the art once the above disclosure is fully appreciated. It is intended that the following claims be interpreted to embrace all such modifications, equivalents, and alternatives where applicable.

It will be appreciated by those skilled in the art that the words during, while, and when as used herein relating to circuit operation are not exact terms that mean an action takes place instantly upon an initiating action but that there may be some small but reasonable delay(s), such as various propagation delays, between the reaction that is initiated by the initial action. Additionally, the term "while" means that a certain action occurs at least within some portion of a duration of the initiating action. The use of the words approximately or substantially means that a value of an element has a parameter that is expected to be close to a stated value or position. The terms first, second, third and the like in the claims or/and in the Detailed Description or the Drawings, as used in a portion of a name of an element are used for distinguishing between similar elements and not necessarily for describing a sequence, either temporally, spatially, in ranking or in any other manner. It is to be understood that the terms so used are interchangeable under appropriate circumstances and that the embodiments described herein are capable of operation in other sequences than described or illustrated herein. Reference to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment, but in some cases it may. Inventive aspects may lie in less than all features of a single foregoing disclosed embodiment. Furthermore, while some embodiments described herein include some, but not other features included in other embodiments, combinations of features of different embodiments are meant to be within the scope of the invention, and form different embodiments, as would be understood by those skilled in the art.

What is claimed is:

1. An active sound cancelling device that comprises: a primary external microphone that produces a primary receive signal; a secondary external microphone that produces a secondary receive signal, the primary and secondary receive signals representing ambient audio that includes sound having a predominate direction of arrival; a speaker that converts an output signal into internal audio to at least partly cancel said sound, the output signal including a forward cancellation signal; a forward filter that operates solely on the primary receive signal to produce the forward cancellation signal; and a direction finder that operates on the primary and secondary receive signals to derive an estimate of said predominate direction of arrival, the direction finder adjusting the forward filter to implement a filter response corresponding to said estimate.

2. The device of claim 1, further comprising a memory that stores filter response parameters for each of multiple directions of arrival, wherein the direction finder accesses the stored filter response parameters corresponding to said estimate.

3. The device of claim 2, wherein the forward filter is a finite impulse response filter or infinite impulse response filter, and the filter response parameters are filter coefficients.

4. The device of claim 2, wherein the forward filter is an analog filter, and the filter response parameters are gain or impedance values for adjustable components of the analog filter.

5. The device of claim 1, further comprising:

an internal microphone that produces an internal receive signal; and a feedback filter that operates on the internal receive signal to produce an internal cancellation signal, wherein the output signal is a sum of the forward cancellation signal and the internal cancellation signal.

6. The device of claim 1, further comprising:

a wireless receiver that produces an audio content signal;

an internal microphone that produces an internal receive signal; and a feedback filter that operates on the internal receive signal to produce an internal cancellation signal, wherein the output signal is a sum of the forward cancellation signal, the internal cancellation signal, and the audio content signal.

7. The device of claim 1, wherein the secondary external microphone is one of multiple secondary microphones producing multiple secondary receive signals, the multiple secondary receive signals solely being used to derive said estimate of said predominate direction of arrival.

8. An electronic component comprising integrated circuitry that includes:

a forward filter configured to operate solely on a primary receive signal from a primary external microphone to produce a forward cancellation signal that forms, or is an additive component of, an output signal for a speaker; and a direction finder configured to combine the primary receive signal with a secondary receive signal from a secondary external microphone to derive an estimate of a predominate direction of arrival of sound represented by the primary and secondary receive signals, the direction finder further configured to adjust the forward filter to implement a filter response corresponding to said estimate.

9. The electronic component of claim 8, wherein the integrated circuitry further includes a memory configured to store filter response parameters for each of multiple directions of arrival, wherein the direction finder is configured to access the stored filter response parameters corresponding to said estimate.

10. The electronic component of claim 9, wherein the forward filter is a finite impulse response filter or infinite impulse response filter, and the filter response parameters are filter coefficients.

11. The electronic component of claim 9, wherein the forward filter is an analog filter, and the filter response parameters are gain or impedance values for adjustable components of the analog filter.

12. The electronic component of claim 8, wherein the integrated circuitry further includes:

a feedback filter configured to operate on an internal receive signal from an internal microphone to produce an internal cancellation signal that is an additive component of the output signal.

13. The electronic component of claim 8, wherein the integrated circuitry further includes:

a wireless receiver configured to produces an audio content signal that is an additive component of the output signal.

14. The electronic component of claim 8, wherein the direction finder is configured to derive the estimate based on multiple secondary receive signals from respective external microphones including said secondary external microphone.

15. A sound cancelling method in an earphone or headphone, the method comprising:

operating on primary and secondary receive signals from primary and secondary external microphones, respectively, to derive an estimate of a predominate direction of arrival of sound represented by the primary and secondary receive signals;

selecting a forward filter response corresponding to said estimate;

applying the forward filter response exclusively to the primary receive signal to produce a forward cancellation signal, the forward cancellation signal forming, or being an additive component of, an output signal; and supplying the output signal to a speaker to at least partly cancel said sound.

16. The method of claim 15, wherein said selecting includes accessing a memory to obtain stored filter response parameters from a memory location corresponding to said estimate.

17. The method of claim 16, wherein said applying uses a finite impulse response filter or infinite impulse response filter and the filter response parameters are filter coefficients.

18. The method of claim 16, wherein said applying uses an analog filter and the filter response parameters are gain or impedance values for adjustable components of the analog filter.

19. The method of claim 15, further comprising:

operating on an internal receive signal from an internal microphone to produce an internal cancellation signal that is an additive component of the output signal.

20. The method of claim 15, further comprising: wirelessly receiving an audio content signal that is an additive component of the output signal.

* * * * *